US005837189A

United States Patent [19]

Westman

[11] Patent Number: 5,837,189

[45] Date of Patent: Nov. 17, 1998

[54] QUENCH MANAGEMENT SYSTEM

[75] Inventor: Kurt H. Westman, Roanoke, Ind.

[73] Assignee: Alfe Systems, Inc., Fort Wayne, Ind.

[21] Appl. No.: 489,136

[22] Filed: Jun. 9, 1995

[51] Int. Cl.[6] ..... C21D 1/62

[52] U.S. Cl. ..... 266/131; 266/133

[58] Field of Search ..... 266/130, 121, 266/114, 112, 131, 132, 133

[56] References Cited

U.S. PATENT DOCUMENTS

| | | | |
|---|---|---|---|
| 2,141,382 | 12/1938 | Ferm | 266/131 |
| 3,163,566 | 12/1964 | Jenkins et al. | 266/131 |
| 4,225,121 | 9/1980 | Meyer et al. | 266/130 |
| 4,336,924 | 6/1982 | Day | 266/130 |

*Primary Examiner*—Scott Kastler
*Attorney, Agent, or Firm*—Randall J. Knuth

[57] ABSTRACT

The invention relates to a quench management system for cooling heat treated workpieces in an alkylene glycol solution. The system includes a quench tank adapted to contain a solution of alkylene glycol into which the heat treated workpieces are immersed for quenching and a rinse tank adapted to contain a solution of alkylene glycol into which the quenched workpieces are immersed. A mechanism for heating the alkylene glycol solution in the rinse tank is provided to thereby cause some of the alkylene glycol in solution to precipitate in the rinse tank. A fluid transport mechanism, such as a pump, is fluidly connected to each of the rinse tank and quench tank, for moving the precipitated alkylene glycol solution from the rinse tank into the quench tank.

9 Claims, 1 Drawing Sheet

QUENCH MANAGEMENT SYSTEM

BACKGROUND OF THE INVENTION

1. Field of the Invention

The present invention relates to quench management systems utilized with heat-treated parts, and, more particularly, to such quench management systems utilizing alkylene glycol.

2. Description of the Related Art

It is known in the heat-treating art that after heat-treating of parts, they must be immediately cooled or quenched to increase the hardness or temper of the piece. In light of this, heat-treated workpieces are dunked or immersed in a tank containing water and solutions of other materials that immediately lower the temperature of the workpiece and increase the strength or hardness of the workpiece. Depending on the workpiece geometry configuration and quenchant fluids utilized, thermal distortion of the pieces may occur, thereby taking the workpiece out of tolerance.

In some glycol quenching systems, a solution of water and alkylene glycol is used to quench the metal parts. It is known that polyalkylene glycol forms a heat conducting layer about the workpiece when the workpiece is immersed in the solution. The polyalkylene glycol in the quenchant liquid allows the heat-treated parts to be quenched cooler without heat-induced warping effects. Glycol raises the boiling point of the quenchant, while preventing speed pockets, i.e., pockets on the workpiece of accelerated or decelerated heat transfer.

Glycol is lost from the quench tank via an amount adhering to the workpieces when removed from the quench tank. Historically, recovery of this glycol was achieved by reverse osmosis procedures on workpiece rinse water in which filters collected the glycol dispersed within the water. Glycol recovery systems operable within a production environment have not been able to recover the majority of the glycol utilized to maintain the proper concentration of the glycol within the quench tank.

What is needed in the art is a cost effective glycol recovery system useful in a production environment.

SUMMARY OF THE INVENTION

The quench management system of the present invention solves the aforementioned problems by applying heat to the rinse tank thereby raising the temperature of the rinse tank solution to approximately 180° to 200° F. In this temperature range, the majority of the glycol in the rinse tank, which is in the concentration range of 2 percent to 5 percent by volume, will cloud and eventually separate or precipitate to the bottom of the rinse tank.

At appropriate times, the quench tank may need additional glycol solution. A pump is utilized to communicate the substantial precipitated or coagulated glycol solution from the rinse tank into the quench tank.

In one form of the invention, burners utilizing natural gas or liquid propane may be used to heat the rinse solution to precipitate the polyalkylene glycol. Alternatively, other sources and methods of applying heat to the solution may be used. Additionally, heat exchangers may be utilized to control the rinse solution temperature.

An advantage of the present invention is that the alkylene glycol utilized in the quenching process may be substantially recovered in a production environment, thereby reducing the need for fresh make-up glycol in the quench tank.

An additional advantage of the present invention is that in a thermal separation of the rinse solution, the solution at the top of the rinse tank will be more reactant, thereby causing full dispersement and removal of the glycol adhering to the heat-treated parts being immersed in the rinse tank.

The invention, in one form thereof, comprises a quench management system for cooling heat treated workpieces in an alkylene glycol solution. The system includes a quench tank adapted to contain a solution of alkylene glycol into which the heat treated workpieces are immersed for quenching and a rinse tank adapted to contain a solution of alkylene glycol into which the quenched workpieces are immersed. A means for heating the alkylene glycol solution in the rinse tank is provided to thereby cause some of the alkylene glycol in solution to precipitate in the rinse tank. Fluid transport means, such as a pump, is fluidly connected to each of the rinse tank and quench tank, for moving the precipitated alkylene glycol solution from the rinse tank into the quench tank.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
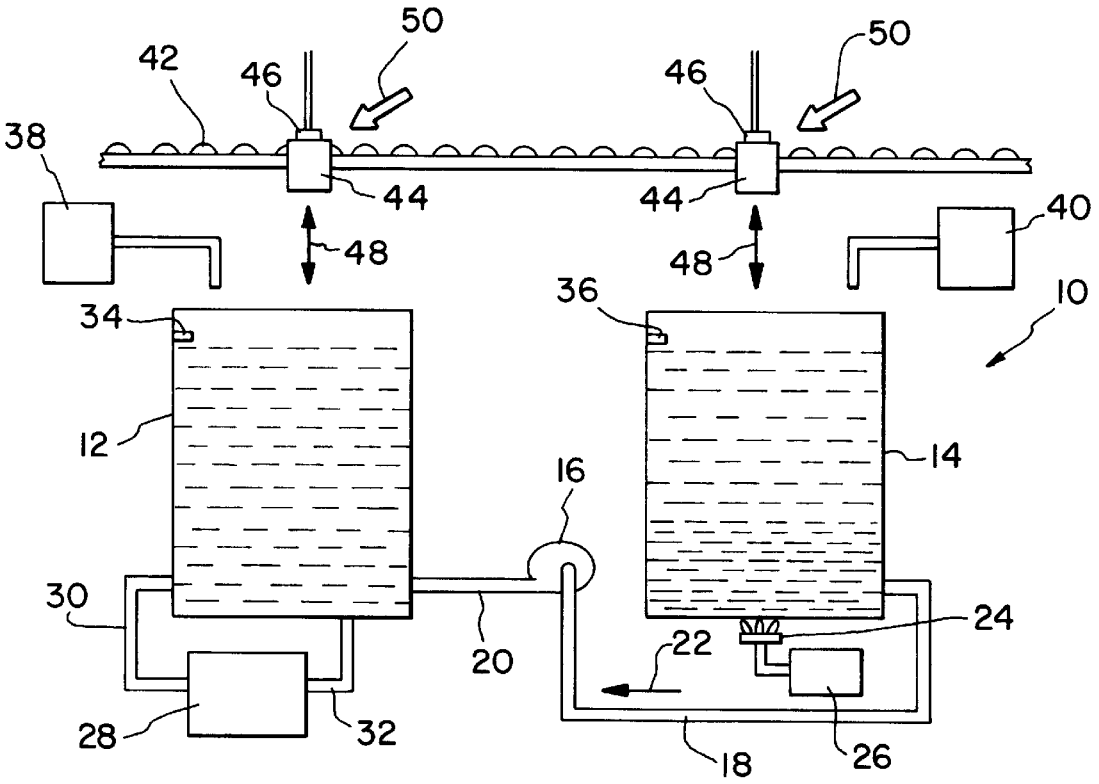
FIG. 1 is a diagramic view of one form of the quench management system of the present invention.

Referring now to the drawings and particularly to FIG. 1, there is shown a quench management system 10 of the present invention. System 10 includes a quench tank 12 and a rinse tank 14. A liquid pump 16 is connected via an inlet pipe 18 to the bottom of rinse tank 14. An outlet pipe 20 connects between pump 16 and quench tank 12. In operation, pump 16 will pump solution within the bottom of rinse tank 14 into quench tank 12. As shown by directional arrow 22, fluid flow through inlet pipe 18 is in a single direction.

System 10 utilizes a solution in quench tank 12 to cool heat treated parts. The preferred solution is that of a mixture of polyalkylene glycol and water, the glycol in the range of approximately 10 percent to 30 percent by volume, and more preferably in the range of 15 percent to 25 percent by volume. One commercially available polyalkylene glycol mixture used for quenching heat treated workpieces is UCON Quenchant A, available from Tenaxol Inc., of Milwaukee, Wis. Alternatively, other brands and types of glycol and solutions thereof, such as ethylene glycol may also be utilized.

This solution supplies polyalkylene glycol to heat treated workpieces immersed in the solution to form a thermally conductive layer to more evenly cool the workpiece. Temperature control of the quench fluid within quench tank 12 is controlled via a separate heat exchanger 28, which acts as a cooling mechanism in fluid communication with the solution within quench tank 12 via heat exchanger inlet and outlet pipes 30 and 32, respectively.

Figure 2:
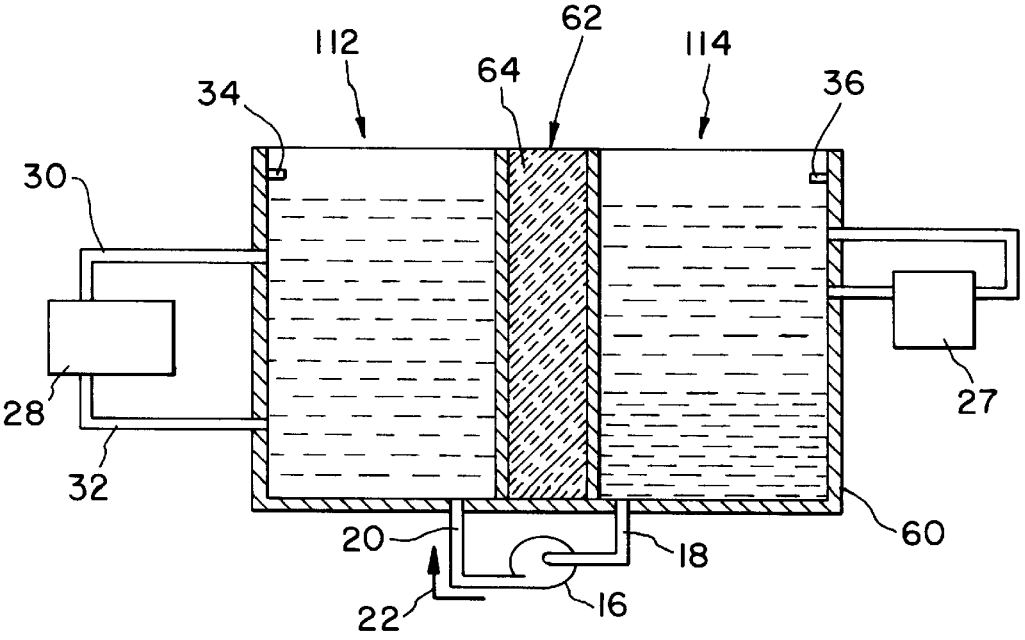
FIG. 2 is an alternate embodiment of the quench management system of FIG. 1 utilizing a unitary tank.

The solution in rinse tank 14 is initially only water, but after use contains a mixture of water and the quenchant solution rinsed from the workpieces immersed in the rinse tank solution. System 10 further includes a mechanism for heating the rinse solution within rinse tank 14 as is shown by a heating means, such as burner 24 connected to a fuel source, such as an LP tank or natural gas supply 26. Alternatively and equivalently, other types of heat sources and methods of heating may be used. This heating of the rinse solution causes the glycol in the solution to precipitate. Alternatively, other mechanisms for heating the solution within rinse tank 14 may be utilized such as heat exchanger 27 as shown in FIG. 2. At the bottom of rinse tank 14, the precipitated glycol solution will be approximately 15 percent to 20 percent glycol by volume.

Each of tanks 12 and 14 include a fluid level sensor or electric eye 34 and 36, respectively, to monitor the top-level of the liquid within each tank. Additionally, water make-up supplies 38 and 40 are associated with tank 12, 14, respectively, for adding make-up water as necessary during operation of the system 10 to compensate for evaporation and other losses. A controller (not shown) may automatically add make-up water or control pump 16 based on the data output of electric eyes 34 and 36.

Other apparatus associated with quench management system 10 includes a workpiece moving means, such as a roller or conveyor belt 42, or the like, to move workpieces 44 from a heat-treatment station (not shown) to quench management system 10 and onto other associated workstations. A means, such as a grappling hook, or plunger mechanism 46, is used to move workpiece 44 from the conveyor belt 42 and immerse the workpiece 44 for a specified length of time within either of quench tank 12 or rinse tank 14, as shown by directional arrows 48. Air knives 50 are utilized to direct air, under pressure, to the workpieces so that excess fluid may be removed.

In operation, the process of one form of the invention involves providing a rinse tank 14 containing a solution of water and alkylene glycols, and then applying heat by a burner 24 or transferring heat to the solution by a heat exchanger 27 (FIG. 2) to precipitate a portion of the alkylene glycol from the solution, and then transporting the precipitated alkylene glycol from rinse tank 14 by means, such as a pump 16, to quench tank 12 for reuse by the heat treatment system.

More particularly, workpiece 44 is moved from an aging oven such as by moving means 42 into position above quench tank 12. At that time a grappling hook or plunger mechanism 46 moves workpiece 44 into the solution within quench tank 12 containing preferably approximately 20 percent glycol solution. Workpiece 44 is immediately quenched from a high temperature in the thousands of degrees to a temperature within the hundreds of degrees in a fraction of a second. Glycol solution covers workpiece 44, permitting a more uniform thermal transfer and preventing speed pockets, thereby reducing warping of workpiece 44.

After a period of time, mechanism 46 raises workpiece 44 out of tank 12 and an air knife 50 blows as much solution as possible off of workpiece 44. After another period of time, conveyor belt 42 moves workpiece 44 into position above rinse tank 14 where another plunger mechanism 46 connects with workpiece 44 and immerses it into the rinse solution within rinse tank 14. The solution within rinse tank 14 near the top is approximately 5 percent glycol, which is at a concentration that is not saturated, thereby pulling or releasing glycol adhering to workpiece 44 into the solution. After being so rinsed, workpiece 44 is moved back to conveyor belt 42, blown with an air knife 50, and moved onto another associated workstation.

The solution within rinse tank 14 is heated to a temperature of approximately 180° to 200° F. during the above described quenching process. A portion of the glycol in solution at this temperature coagulates or precipitates down to the bottom of the tank into a portion where it is approximately 15 percent glycol by volume, forming a large gelatinous mass. At times, when necessary, as indicated by an electric eye 34 or by chemical measurements of the concentration of the glycol in quench tank 12, pump 16 may be operated either manually or by a computer control to pump precipitated glycol from the bottom of rinse tank 14 through inlet pipe 18 and outlet pipe 22 into quench tank 12. In this manner, the preferred 15 to 20 percent solution of glycol may be maintained in quench tank 12. The solution within quench tank 12 is cooled by heat exchanger 28 to thereby maintain the solution in quench tank 12 at a temperature in which the glycol does not precipitate. If necessary, water may be added via water make-up tanks 38 or 40 into respective tanks 12,14.

An alternate embodiment of quench tank 12 and rinse tank 14 is shown in FIG. 2, in which a unitary or monolithic quench tank 60 is substituted therefore. Tank 60 contains both the quench liquid from quench tank 12 and rinse solution from rinse tank 14 as described. A divider 62 is disposed and welded within tank 60 to separate tank 60 into a primary quench portion 112 and a secondary rinse portion 114. Divider 62 may include an insulative layer 64, formed of fiberglass or the like, to prevent heat transfer from the rinse solution in secondary rinse portion 114 to primary quench portion 112.

Additionally, heat exchanger 27 will be utilized to heat the solution in the secondary rinse portion 114 (FIG. 2). Heat exchanger 28 is located on an opposite side of tank 60 to ensure the temperatures within portions 112 and 114 remain different. Conveyor 42 and make up tanks 38 and 40 are not shown for clarity in FIG. 2. In all other aspects, system 10 operates as previously described.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A quench management system for cooling heat treated workpieces in an alkylene glycol solution, said system comprising:

a quench tank adapted to contain a solution of alkylene glycol into which the heat treated workpieces are immersed for quenching;

a rinse tank adapted to contain a solution of alkylene glycol into which the quenched workpieces are immersed;

means for heating the alkylene glycol solution in said rinse tank to thereby cause some of the alkylene glycol in solution to precipitate in said rinse tank;

a cooling mechanism in communication with the alkylene glycol solution in said quench tank, said cooling mechanism adapted to keep said solution in said quench tank below a temperature at which the alkylene glycol precipitates; and fluid transport means, fluidly connected to each of said rinse tank and said quench tank, for moving the precipitated alkylene glycol solution from said rinse tank into said quench tank.

2. The quench management system of claim 1 in which said heating means comprises a burner.

3. The quench management system of claim 1 in which said heating means comprises a heat exchanger.

4. The quench management system of claim 1 in which said heating means is adapted to heat the alkylene glycol solution in said rinse tank to a temperature within the range of approximately 180 to 200 degrees Fahrenheit.

5. The quench management system of claim 1 in which said heating means is controllable to cause the precipitated alkylene glycol to have a concentration of approximately 15% to 20% alkylene glycol by volume.

6. A quench management system for cooling heat treated workpieces, said system comprising:

a quench tank adapted to contain a solution of water and alkylene glycol into which the heat treated workpieces are immersed;

an insulative divider disposed in said quench tank thereby dividing said quench tank into a primary quench portion and a secondary rinse portion;

a cooling mechanism in communication with the solution in said quench tank, said cooling mechanism adapted to keep the solution in said primary quench portion below a temperature at which the alkylene glycol precipitates;

and heating means for heating the solution in said secondary rinse portion.

7. The quench management system of claim 6 wherein said heating means causes the alkylene glycol in the solution to precipitate in said secondary rinse portion, said system further including a pump means for pumping the precipitated alkylene glycol from said secondary rinse portion to said primary quench portion.

8. The quench management system of claim 7 in which said heating means comprises a heat exchanger.

9. The quench management system of claim 7 in which said heating means is adapted to heat the rinse solution in said secondary rinse portion to a temperature within the range of 180 to 200 degrees Fahrenheit.

* * * * *